US007325319B2

(12) United States Patent
Smith

(10) Patent No.: US 7,325,319 B2
(45) Date of Patent: Feb. 5, 2008

(54) ARROW-MOUNTED SIGHT

(76) Inventor: Jon C. Smith, 2831 Annandale Rd., Falls Church, VA (US) 22042

( * ) Notice: Subject to any disclaimer, the term of this patent is extended or adjusted under 35 U.S.C. 154(b) by 0 days.

(21) Appl. No.: 11/224,988

(22) Filed: Sep. 14, 2005

(65) Prior Publication Data

US 2007/0062052 A1 Mar. 22, 2007

(51) Int. Cl.
*F41G 1/00* (2006.01)

(52) U.S. Cl. ..... 33/265; 124/87; 473/578

(58) Field of Classification Search ..... 33/265, 33/263; 124/86, 87; 473/578
See application file for complete search history.

(56) References Cited

U.S. PATENT DOCUMENTS

| | | | | | |
|---|---|---|---|---|---|
| 2,715,895 | A | * | 8/1955 | Loveless | 124/20.3 |
| 3,455,027 | A | * | 7/1969 | Perkins | 33/265 |
| 3,455,288 | A | * | 7/1969 | Knerr | 124/22 |
| 4,105,209 | A | | 8/1978 | Bizzell et al. | |
| 4,170,071 | A | | 10/1979 | Mann et al. | |
| 4,385,448 | A | | 5/1983 | Burkey | |
| 4,481,717 | A | * | 11/1984 | Kowalski | 33/265 |
| 4,744,347 | A | * | 5/1988 | Dodge | 124/86 |
| 4,813,150 | A | | 3/1989 | Colvin | |
| 4,873,963 | A | * | 10/1989 | Lemmen | 124/20.3 |
| 4,905,397 | A | * | 3/1990 | Juelg, Jr. | 473/578 |
| 5,231,765 | A | | 8/1993 | Sherman | |
| 5,375,047 | A | | 12/1994 | Mueller | |
| 5,464,003 | A | * | 11/1995 | Sherman | 33/265 |
| 5,560,113 | A | | 10/1996 | Simo et al. | |
| 6,134,793 | A | * | 10/2000 | Sauers | 33/265 |
| 6,394,919 | B1 | * | 5/2002 | Ossege | 473/582 |
| 6,418,633 | B1 | | 7/2002 | Rager | |
| 6,494,604 | B2 | | 12/2002 | Khoshnood | |
| 6,517,453 | B2 | * | 2/2003 | LaSee | 473/578 |
| 6,560,884 | B1 | | 5/2003 | Afshari | |
| 6,601,308 | B2 | | 8/2003 | Khoshnood | |
| 6,856,250 | B2 | * | 2/2005 | Hilliard | 473/578 |
| 2003/0045381 | A1 | * | 3/2003 | Morris et al. | 473/578 |
| 2003/0172463 | A1 | * | 9/2003 | Marfione | 7/158 |
| 2004/0031162 | A1 | | 2/2004 | Rager | |
| 2005/0278964 | A1 | * | 12/2005 | Minica et al. | 33/265 |

* cited by examiner

*Primary Examiner*—G. Bradley Bennett
*Assistant Examiner*—Travis Reis
(74) *Attorney, Agent, or Firm*—Kramer & Amado, P.C.

(57) ABSTRACT

An arrow sight is shown. The arrow sight includes a coupling portion for attachment to an arrow. The arrow sight also includes a targeting portion attached to the coupling portion. The targeting portion includes an aiming guide used to assist an archer in aiming the arrow.

16 Claims, 3 Drawing Sheets

ARROW-MOUNTED SIGHT

BACKGROUND

Archers often aim at various targets that are at different distances from their location. A challenge therefore exists to account for these multiple distances and still hit the target successfully. In order to account for different distances, an archer must alter the angle at which the arrow leaves the bow. Bow sights were developed in order to assist archers in accomplishing this task more easily.

Conventional bow sights have a mounting bracket which attaches to the riser of the bow, a mounting arm which extends forwardly from the bracket and a sight ring which contains one or more sight pins. Other bow sights or "peep sights" attach to the bowstring. It is well known in the archery field to provide bows with sights to improve the accuracy of arrows shot from the bow. As stated above, the sights are often mounted on the riser of the bow. The flight path of an arrow is parabolic and conventional sights provide different aiming guides to account for the different distances between the target and the archer. This may be done by providing a plurality of pins in the sight. The pins are usually vertically spaced, with each pin acting as an aiming guide for a particular target distance.

One of the drawbacks of conventional bow-mounted sights is that the fact that the sight mechanism is attached to the bow riser or bowstring. This results in an increased weight of the bow. The increased weight affects the archer's ability to maintain the bow in the correct position while aiming the arrow. The presence of a bow-mounted sight on the bow riser may also obstruct an archer's clear view of the target.

What is needed is a sight for a bow that allows an archer to account for multiple distances when aiming at a target and yet does not obstruct the archer's view of the target or add significant weight to the archer's bow. A less costly targeting system is also desirable.

SUMMARY

According to an embodiment, an arrow sight includes a coupling portion for attachment to an arrow. The arrow sight also includes a targeting portion attached to the coupling portion. The targeting portion includes an aiming guide used to assist an archer in aiming the arrow.

BRIEF DESCRIPTION OF THE DRAWINGS

Examples of the invention are illustrated, without limitation, in the accompanying figures in which like numeral references refer to like elements and wherein.

DETAILED DESCRIPTION

For simplicity and illustrative purposes, the principles are shown by way of examples of systems and methods described. In the following description, numerous specific details are set forth in order to provide a thorough understanding of the examples. It will be apparent however, to one of ordinary skill in the art, that the examples may be practiced without limitation to these specific details. In other instances, well known methods and structures are not described in detail so as not to unnecessarily obscure understanding of the examples.

As used herein, the word "arrow" means a projectile launched from a device such as a bow, compound bow, or crossbow, without the aid of explosive or chemical means. Examples of arrows include, but are not limited to, archery arrows, hunting arrows and crossbow darts.

Figure 1A:
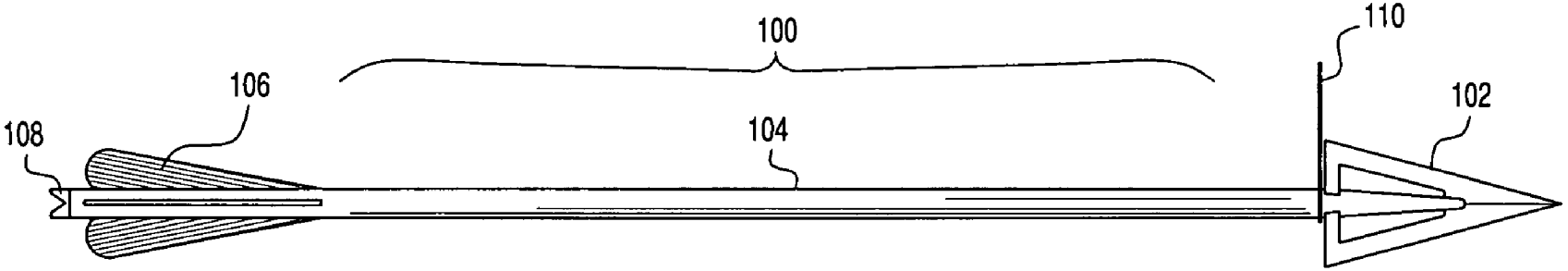
FIGS. 1A and 1B, collectively, show an arrow-mounted sight according to an embodiment of the present invention.

Referring now to the drawings, FIG. 1A shows an arrow 100 used in archery or hunting. The arrow 100 includes a head 102, an arrow shaft 104, a fletching 106 and a bowstring notch 108. The head 102 may be a field tip, broad point, or other type of attachment used for hunting or target practice. One function of the head 102 is to pierce the hide, skin or outer surface of the target.

Figure 2A:
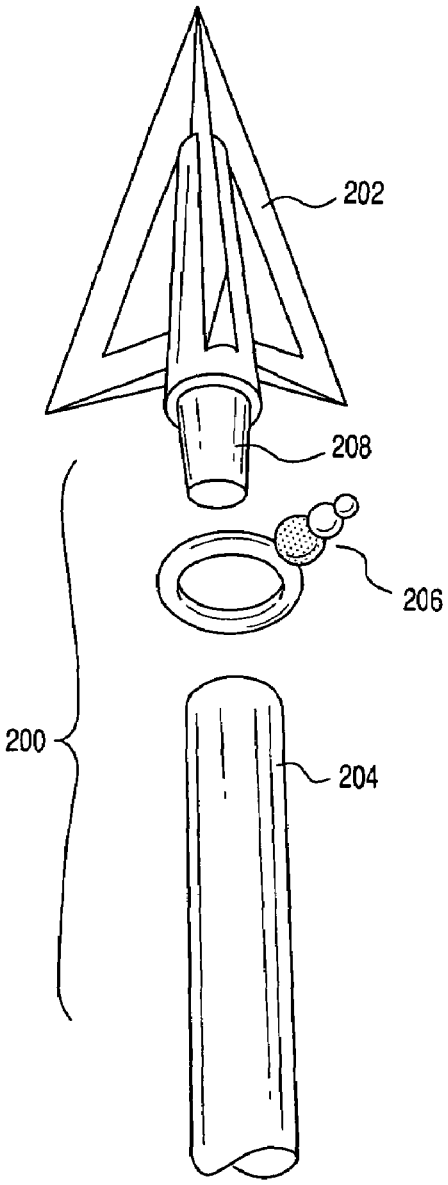
FIGS. 2A and 2B, collectively, show an arrow-mounted sight according to another embodiment of the present invention.

As shown in FIG. 1A, the head 102 is attached to the shaft 104 by screwing it to the arrow shaft 104 via a screw thread (shown in FIG. 2A). The arrow sight 110 fits around the shaft 104 of the arrow 100. The head 102 maybe removed from the shaft 104 by unscrewing it. An archer would remove the head 102, slide the arrow sight 110 along the shaft 104 and replace the head 102 in its original position. Alternatively, if a field tip is used then the head 102 need not be removed. Due to the smaller configuration of a field tip the arrow sight 110 may be slid over it and directly onto the shaft 104.

Figure 1B:
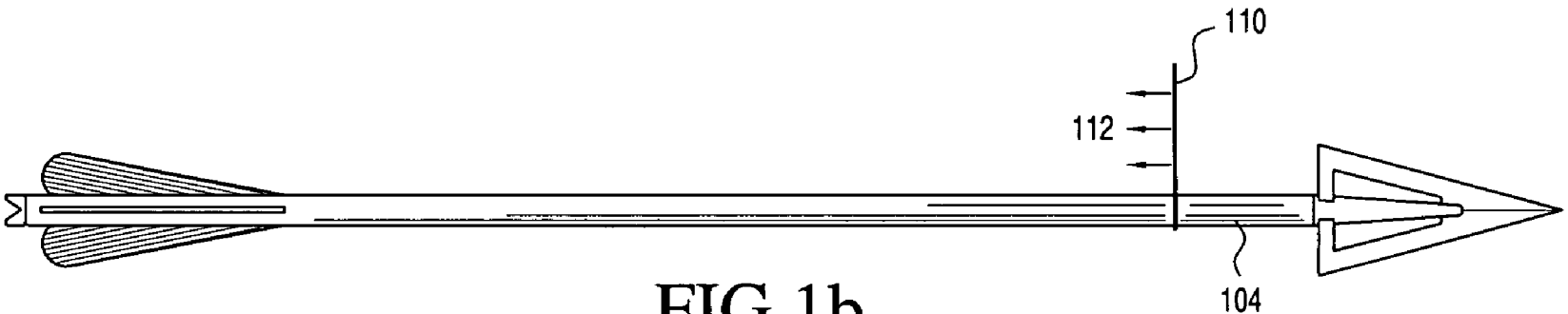

During flight and upon impact with the target the arrow sight 110 may slide back along the shaft 104 toward the fletching 106. The arrow sight 110 will slide along the path depicted by the markings 112 as shown in FIG. 1B. This is partly due to the lightweight and flexible nature of the arrow sight 110. Additionally, since the arrow sight 110 is removably mounted upon the arrow 100, it does not stay in a fixed position. The slidably mounted arrow sight 110 may not enter the body of an animal when the arrow sight 110 is used for hunting. Likewise, since the arrow sight 110 slides away from the point of impact, the arrow sight 110 may not be damaged when the arrow 100 is used with an archery target or other rigid targets. This allows the arrow sight 110 to be reused, thus reducing the overall costs of use.

FIG. 2A shows an arrow 200 disassembled into a head 202 and a shaft 204. An arrow sight 206 sits between the head 202 and the shaft 204. According to one embodiment of the invention, the arrow sight 206 is mounted upon the screw thread 208 of the head 202. The head 202 is then screwed onto the shaft 204 using the screw thread 208.

Figure 2B:
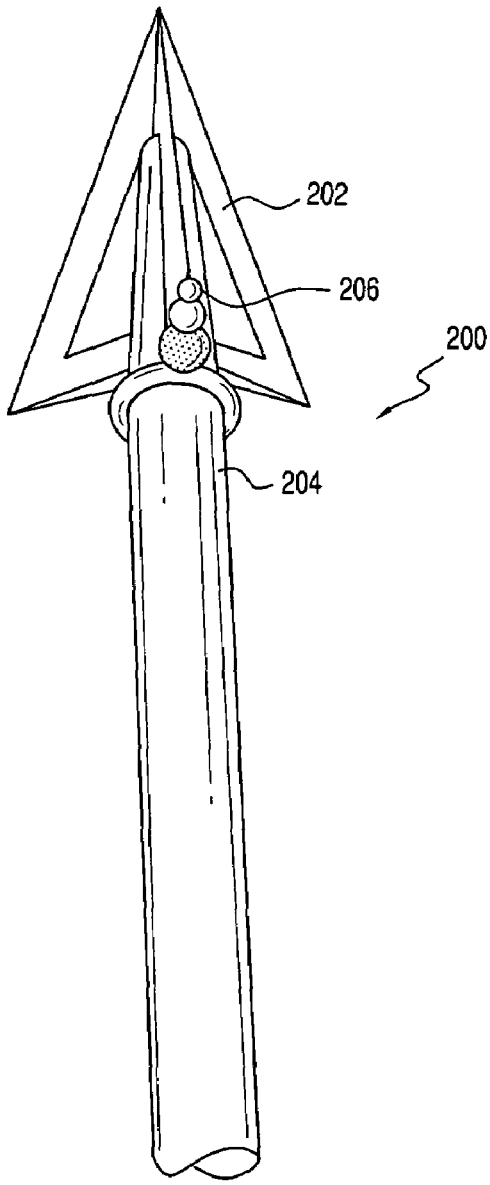

FIG. 2B shows the head 202 in its normal position at the end of the shaft 204. The arrow sight 206 is located between the head 202 and the shaft 204. When the head 202 is screwed onto the shaft 204, the arrow sight 206 is held therein. The head 202 is returned to substantially the same location next to the shaft 204 as if the arrow sight 206 were not present. The arrow sight 206 remains in place between the head 202 and the shaft 204 until removed. Due to the lightweight and flexible nature of the arrow sight 206, the flight path of the arrow 200 may not be affected by the presence of the arrow sight 206.

Figure 3:
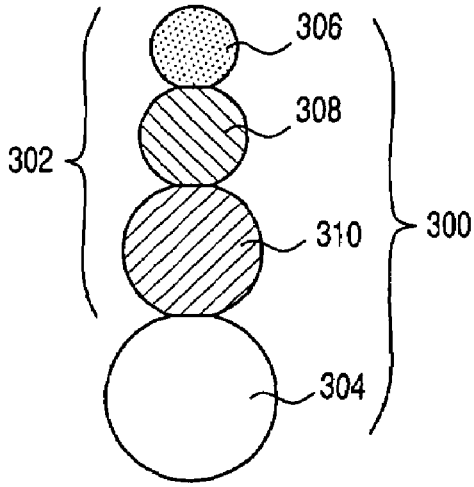
FIG. 3 shows an arrow-mounted sight according to another embodiment of the present invention.

FIG. 3 shows an arrow sight 300 according to an embodiment of the present invention. The arrow sight 300 includes a targeting portion 302 and a coupling portion 304. The targeting portion 302 includes aiming guides 306, 308 and 310. FIG. 3 shows an arrow sight 300 containing three aiming guides. However, the arrow sight 300 may include any number of aiming guides in any number of configurations.

The coupling portion 304 is designed to fit along the shaft 104 of an arrow 100 or between the shaft 204 and the head 202 of an arrow 200 as shown in FIGS. 1A and 2B. The coupling portion 304 may be in an annular configuration. This configuration is chosen because it conforms to the cylindrical nature of the shaft. However, as shown below, other configurations of the coupling portion 304 are possible.

The coupling portion 304 is attached to the targeting portion 302. In a preferred embodiment of the invention, the targeting portion 302 is perpendicular to the axis of an arrow shaft and oriented toward the top of the archer's field of vision. Other orientations of the targeting portion 302 are possible. For example, the targeting portion 302 maybe oriented at a more acute angle with respect to an arrow. Likewise, the targeting portion 302 may be oriented toward the left side, right side, bottom or other points along the archer's field of vision.

The aiming guides 306, 308 and 310 are used by the archer to gauge the distance to a target. The aiming guide 306 furthest from the coupling portion 304 is used for close distances, the middle aiming guide 308 for intermediate distances and the aiming guide 310 closest to the coupling portion 304 for far distances. Many variables affect the distance an arrow will fly. Examples of variables that will affect distance include wind conditions, bow type, bowstring tension and the size, shape, weight and configuration of the arrow. Testing of the arrow sight 304 has indicated that the aiming guide 306 furthest from the coupling portion 304 may be useful when aiming at targets relatively close. The second and third aiming guides 308 and 310 may be useful for targets progressively further away.

In one example, the aiming guides 306, 308 and 310 are circular and of differing size. This is done partly to insure that the first aiming guide 306 does not obscure the archer from seeing the second or third aiming guides 308, 310. If the first aiming guide 306 is smaller than the second 308 then the second aiming guide 308 may still be visible when the archer looks down the targeting member 302 toward the second aiming guide 308. Likewise, the second aiming guide 308 should not obscure the archer's view of the third aiming guide 310.

Figure 5:
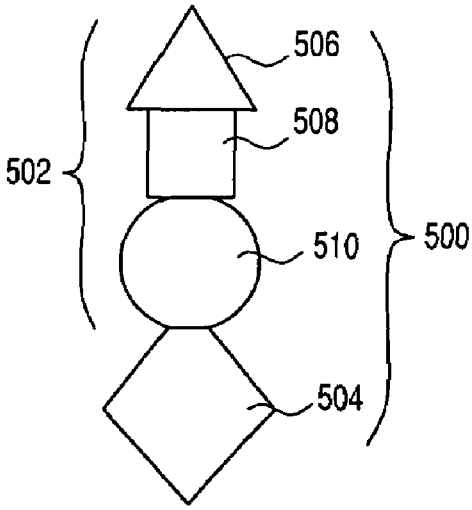
FIG. 5 shows an arrow-mounted sight according to another embodiment of the present invention.

In another example, the first aiming guide 306 may be colored red, the second 308 maybe colored yellow and the third aiming guide 310 may be colored green. Any color combinations may be used. Additionally, different shapes or sizes may be used to differentiate one aiming guide from the others. For example, as seen in FIG. 5, the first aiming guide 506 may be triangular, the second aiming guide 508 square and the third aiming guide 510 circular. Other arrangements are possible, and further permutations may be helpful when more than three aiming guides are present on the targeting portion 302 or 502.

In yet another example, the targeting portion 302 may be transparent except for the aiming guides 306, 308 and 310. As discussed above, the aiming guides 306, 308 and 310 may be discernable from one another on the basis of size, shape and color. A transparent targeting portion 302 may be useful in not obscure the archer's field of vision.

In yet another example, the targeting portion 302 may be constructed of a lightweight and/or flexible material. The coupling portion 304 may be flexible or rigid. The flexible nature of the targeting portion 302 allows for bending during flight. This may provide for a smoother arrow flight.

Figure 4:
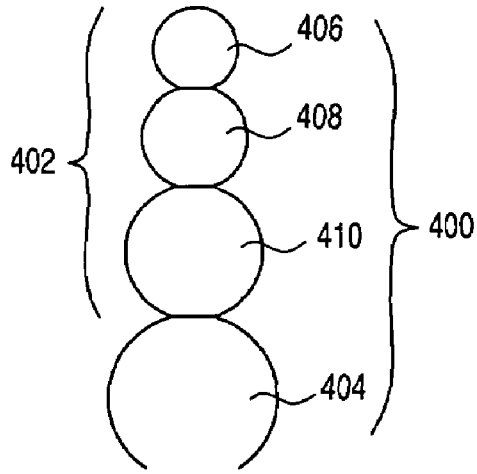
FIG. 4 shows an arrow-mounted sight according to another embodiment of the present invention.

FIG. 4 shows another example of an arrow sight 400 including a targeting portion 402 and three aiming guides 406, 408 and 410. The coupling portion 404 may be penannular. The penannular coupling portion 404 substantially surrounds a shaft of an arrow but does not completely encircle or encompass it. Other penannular configurations of the coupling portion 404 that allow the arrow sight 400 to remain attached to the shaft at least during aiming of the arrow are possible.

FIG. 5 shows another example of an arrow sight 500 including a targeting portion 502 and three aiming guides 506, 508 and 510. The coupling portion 504 may be have a polygon configuration. This type of coupling portion 504 may completely surround a shaft of an arrow. A square configuration is shown in FIG. 5. However, any configuration comprising a plane figure bounded by three or more line segments is possible.

Figure 6:
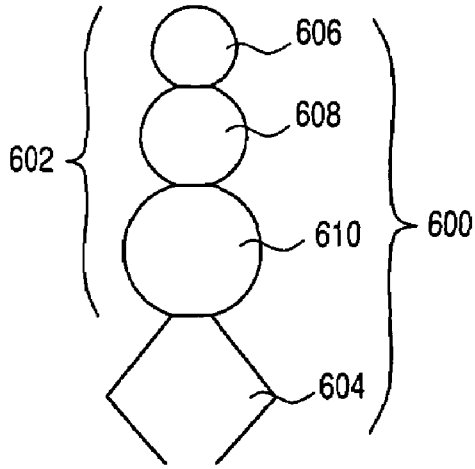
FIG. 6 shows an arrow-mounted sight according to another embodiment of the present invention.

FIG. 6 shows another example of an arrow sight 600 including a targeting portion 602 and three aiming guides 606, 608 and 610. The coupling portion 604 may be an incomplete polygon. This configuration of the coupling portion 604 substantially surrounds a shaft of an arrow but does not completely encircle or encompass it. The configuration of the coupling portion 604 may be nearly that of a square. However, any configuration wherein the coupling portion contacts the shaft at two or more points may be possible. The coupling portion 604 may have as few as two sides that substantially surround the shaft.

What has been described and illustrated herein are examples of the systems and methods described herein along with some of their variations. The terms, descriptions and figures used herein are set forth by way of illustration only and are not meant as limitations. Those skilled in the art will recognize that many variations are possible within the spirit and scope of these examples, which are intended to be defined by the following claims and their equivalents, in which all terms are meant in their broadest reasonable sense unless otherwise indicated.

What is claimed is:

1. An arrow sight, comprising:

a coupling portion for removably attaching the arrow sight to an arrow; and a targeting portion attached to the coupling portion, the targeting portion including an aiming guide used to assist an archer in aiming the arrow; wherein the coupling portion is slidably attached to the arrow at any point along a shaft of the arrow;

wherein said coupling portion remains attached to said arrow while said arrow is in flight.

2. The arrow sight of claim 1 wherein the coupling portion is penannular, said coupling portion substantially surrounding a shaft of the arrow but not completely encircling said shaft.

3. The arrow sight of claim 1 wherein the targeting portion contains at least two aiming guides used to assist an archer in aiming the arrow.

4. The arrow sight of claim 3 wherein the aiming guides are different from each other by at least one of color, size and shape.

5. The arrow sight of claim 1 wherein the targeting portion comprises a flexible material comprising at least one of plastic, rubber, metal alloy, shape-memory metal alloy and fabric.

6. An arrow sight, comprising:

a coupling portion for removably attaching the arrow sight to an arrow; and a targeting portion attached to the coupling portion, the targeting portion including an aiming guide used to assist an archer in aiming the arrow; wherein the coupling portion is removably attached to the arrow at a junction between a head of the arrow and a shaft of the arrow;

wherein said coupling portion remains attached to said arrow while said arrow is in flight.

7. An arrow sight, comprising:

a coupling portion for removably attaching the arrow sight to an arrow; and a targeting portion attached to the coupling portion, the targeting portion including an aiming guide used to assist an archer in aiming the arrow; wherein the coupling portion is annular, the coupling portion surrounding a shaft of the arrow;

wherein said coupling portion remains attached to said arrow while said arrow is in flight.

8. An arrow sight, comprising:

a coupling portion for removably attaching the arrow sight to an arrow; and a targeting portion attached to the coupling portion, the targeting portion including an aiming guide used to assist an archer in aiming the arrow; wherein the coupling portion is a polygon, said coupling portion surrounding a shaft of the arrow;

wherein said coupling portion remains attached to said arrow while said arrow is in flight.

9. An arrow comprising an elongated arrow portion and an arrow sight said arrow sight comprising:

a coupling portion for removably and slidably attaching the arrow sight to the elongated arrow portion; and a targeting portion attached to the coupling portion, the targeting portion including an aiming guide used to assist an archer in aiming the arrow;

wherein the targeting portion contains at least two aiming guides used to assist an archer in aiming the arrow; and wherein the arrow sight comprises transparent material except for the aiming guides.

10. An arrow sight, comprising:

a coupling portion for attaching the arrow sight to an arrow; and a targeting portion attached to the coupling portion, the targeting portion including at least two aiming guides used to assist an archer in aiming the arrow; wherein the coupling portion is removably attached to the arrow at a junction between a head of the arrow and a shaft of the arrow;

wherein said coupling portion remains attached to said arrow while said arrow is in flight.

11. The arrow sight of claim 10 wherein the aiming guides are different from each other by at least one of color, size and shape.

12. The arrow sight of claim 10 wherein the coupling portion is removably attached to the arrow at any point along a shaft of the arrow.

13. An arrow sight, comprising:

a coupling portion for attaching the arrow sight to an arrow at a junction between a head of the arrow and a shaft of the arrow; and a targeting portion attached to the coupling portion, the targeting portion including at least two aiming guides used to assist an archer in aiming the arrow; wherein the arrow sight comprises transparent material except for the aiming guides;

wherein said coupling portion remains attached to said arrow while said arrow is in flight.

14. An arrow sight, comprising:

a coupling portion for attaching the arrow sight to an arrow; and a targeting portion constructed of a flexible material and attached to the coupling portion, the targeting portion including an aiming guide used to assist an archer in aiming the arrow;

wherein the targeting portion comprises a flexible material comprising at least one of plastic, rubber, metal alloy, shape-memory metal alloy and fabric; and wherein the coupling portion is removably attached to the arrow at a junction between a head of the arrow and a shaft of the arrow;

wherein said coupling portion remains attached to said arrow while said arrow is in flight.

15. The arrow sight of claim 14 wherein the coupling portion comprises a flexible material comprising at least one of plastic, rubber, metal alloy, shape-memory metal alloy and fabric.

16. The arrow sight of claim 14 wherein the targeting portion contains at least two aiming guides used to assist an archer in aiming the arrow.

* * * * *